United States Patent [19]

Carson et al.

[11] Patent Number: 4,693,702

[45] Date of Patent: Sep. 15, 1987

[54] ROTOR HAVING FRANGIBLE PROJECTIONS THEREON

[75] Inventors: David M. Carson, Newtown; Oakley L. Weyant, Jr., Southbury, both of Conn.

[73] Assignee: E. I. Du Pont de Nemours and Company, Wilmington, Del.

[21] Appl. No.: 892,262

[22] Filed: Aug. 4, 1986

[51] Int. Cl.[4] ..... B04B 7/02; B04B 15/02; B04B 9/10

[52] U.S. Cl. ..... 494/61; 494/13/84

[58] Field of Search ..... 494/61, 84, 83, 46, 494/23, 39, 37, 13, 85; 210/927, 781, 782

[56] References Cited

U.S. PATENT DOCUMENTS 3,961,745 6/1976 Wright ..... 233/1

3,990,633 11/1976 Stahl et al. ..... 233/23

4,054,243 10/1977 Volkov et al. ..... 494/61

4,226,669 10/1980 Vilardi ..... 494/61

4,244,513 1/1981 Fayer ..... 494/61

4,568,325 2/1986 Cheng et al. ..... 494/84

*Primary Examiner*—Robert W. Jenkins

[57] ABSTRACT

A centrifuge rotor is provided with a pair of projections frangibly connected thereto. As the rotor reaches a predetermined speed the projections simultaneously fracture forming projectiles which puncture the evacuated chamber in which the rotor is mounted. Ambient air is drawn into the chamber, thereby windage limiting the speed of the rotor. The projections are each sized and positioned to impart a total unbalance less than the multiplication product of 0.5 gram-inches times the weight of the rotor.

20 Claims, 3 Drawing Figures

ROTOR HAVING FRANGIBLE PROJECTIONS THEREON

BACKGROUND OF THE INVENTION

1. Field of the Invention

The present invention relates to a centrifuge rotor for an evacuated centrifuge instrument and, in particular, to a rotor having a projection of a predetermined weight mounted to the rotor at a predetermined position thereon so as to be separable from the rotor at a predetermined rotor speed without causing the rotor to leave its drive mount.

2. Description of the Prior Art

A centrifuge instrument is a device adapted to expose a liquid sample to a centrifugal force field. The sample is disposed in a suitable container which is itself carried in a rotor member that is rotationally mounted within the centrifuge. The rotor is adapted to be driven to an extremely high rotational speed, often in excess of fifty thousand revolutions per minute, to generate the centrifugal force field.

The rotor is a relatively massive member fabricated of a high strength material such as titanium. To reduce the power requirements of the drive the centrifuge has an evacuable chamber in which the rotor is spun. The evacuated chamber minimizes the effects of windage (i.e., air friction) on the rotor.

Due to the high energy imparted to a massive member such as a rotor when the same is rotated at the extremely high rotational speed generated in a centrifuge, control of rotor speed is especially important. Extreme care must be exercised in order to maintain the rotational speed of the rotor under its burst speed. Burst speed is the speed at which the rotor will disintegrate and fly apart.

Rotor speed is typically controlled through the use of electronic networks associated with the electronic speed control arrangement for the centrifuge. In addition, prior art systems are available which attempt to limit rotor speed through the use of mechanical expedients. Generally speaking, such expedients include structural members attached to the rotor which become disassociated from the rotor in response to excessive rotor speed.

Exemplary of such a system is that shown in U.S. Pat. No. 3,961,745 (Wright). In this patent a breakable safety linkage is mounted to the rotor and arranged to fracture when the rotor reaches a predetermined rotational speed. When the safety linkage breaks the rotor becomes unbalanced, resulting in a shut-down of the centrifuge, usually manifested by an interruption of motive energy from the centrifuge drive. Other examples of devices generally similar in principle are disclosed in U.S. Pat. No. 3,990,633 (Stahl et al.) and U.S. Pat. No. 4,568,325 (Cheng et al.). Both of these patents disclose breakable members attached to the underside of the rotor. The members fracture when a predetermined rotor speed is reached thereby to isolate the rotor from its drive connection, thus causing the rotor to leave the drive.

In all of these mechanical arrangements, however, the effect of the mechanical fracture of the members is to unbalance the rotor and cause the same to leave its mounting to the drive. The rotor then physically displaces within the chamber in a random, unpredictable manner. As a result the cover of the rotor could become separated therefrom, perhaps spilling the samples on the interior of the instrument. Further, the rotor could be severely damaged, necessitating its replacement. Either or both of these consequences is perceived as disadvantageous.

In view of the foregoing it is believed to be desirable to provide a mechanical expedient whereby rotor overspeed may be prevented yet at the same time effect such control without the deleterious effect of causing the rotor to dismount from its drive connection.

SUMMARY OF THE INVENTION

The present invention relates to a centrifuge rotor adapted for use in a centrifuge instrument of the type having an enclosable and evacuable chamber. A rotor drive member projects into the chamber to connect the rotor to a motive source.

In accordance with the present invention the rotor is provided with at least one projection connected to the rotor through a frangible connecting region. The frangible connecting region is configured so as to fracture and separate the projection from the rotor when the rotor is driven past a predetermined speed less than its predetermined burst speed. The projection is sized and positioned on the rotor so that the projection exhibits an unbalance that is less than a predetermined value of unbalance defined by the multiplication product of 0.5 gram-inches for each pound of rotor weight. As a result the separation of the projection from the rotor occurs without unbalancing the rotor to such an extent that the rotor is caused to leave its drive member. Upon separation the projection forms a projectile that has an energy content sufficient to puncture the chamber in which the rotor is received. Puncture of the chamber admits air thereinto to windage limit the rotational speed of the rotor.

In the preferred embodiment a pair of projections are mounted to the rotor, with each projection exhibiting an unbalance that is less than the predetermined value of unbalance defined above. The projections are affixed through frangible connections to a collar member that is itself mounted to the rotor at a convenient location thereon. The collar may be integrally formed on the rotor or otherwise suitably attached thereto. The frangible connections are sized and configured to fracture when the rotor reaches a predetermined rotor speed. As a result a projectile is formed within the rotor chamber. The projectile is imparted with sufficient energy to puncture the chamber to permit ambient air to enter into the chamber and, through windage action, limit rotor speed to a speed below the critical disintegration speed of the rotor.

BRIEF DESCRIPTION OF THE DRAWINGS

The invention may be more fully understood from the following detailed description thereof, taken in connection with the accompanying drawings, which form a part of this application and in which.

DETAILED DESCRIPTION OF THE INVENTION

Figure 1:
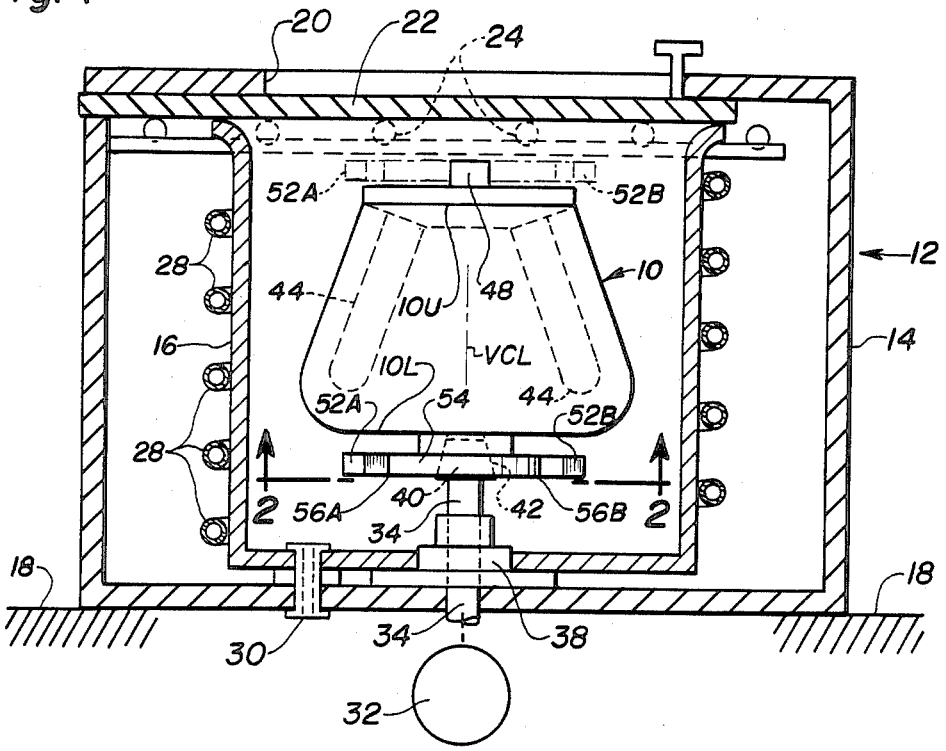
FIG. 1 is a side elevational view, partially in section, of a centrifuge instrument having a rotor in accordance with the present invention disposed therein.

Throughout the following detailed description similar reference numerals are used to denote similar elements in all figures of the drawings.

With reference to FIG. 1 shown is a highly stylized view of a centrifuge rotor 10 in accordance with the present invention. The rotor 10 is disposed within a centrifuge instrument generally indicated by reference character 12 of the type having an evacuable chamber. It should be noted that the present invention is applicable to any rotor used in any evacuated chamber, whatever the rated speed of operation of the rotor.

The centrifuge 12 includes an outer housing 14 which surrounds a bowl, or chamber, 16. The housing 14 is supported within a suitable framework, as indicated diagrammatically at 18, in any convenient manner. The housing 14 is appropriately reinforced by the provision of suitable guard rings or the like, as will be appreciated by those skilled in the art.

The housing 14 has an access aperture 20 provided therein. The aperture 20 is closed by a door 22 slidably mounted with respect to the housing 14 on a roller arrangement 24. The appropriately reinforced housing 14 together with the door 22 serve a containment function to confine any missiles which may emanate from the chamber 14.

The chamber 16 is surrounded by an evaporator coil arrangement 28 connected to a refrigeration system (not shown) whereby the temperature of the rotor 10 and the contents thereof may be regulated. The interior of the chamber 16 is evacuable through a suitable vacuum port 30 connectable to a vacuum pump or the like.

Any suitable source of motive energy, such as an oil turbine 32, is connected to a drive shaft 34. The upper end of the drive shaft 34 projects into the chamber 16 through a vacuum seal and bearing package 38. The upper end of the shaft 34 is provided with a mounting element, or "spud", 40 onto which the rotor 10 is received in a driven relationship.

The rotor 10 is itself a relatively massive member formed of a high strength material such as titanium. The rotor 10 has a lower surface 10L and an upper surface 10U thereon. The lower surface 10L of the rotor body is provided with a recess 42 sized to receive the drive spud 40. The rotor 10 is provided with an annular array of cavities 44 each of which is typically inclined to the central axis of rototion VCL. The cavities 44 are sized to closely receive and support containers carrying the liquid sample to be subjected to the centrifugal force field generated by the rotation of the rotor. The rotor 10 may be provided with a suitable cover 46, if desired. The cover 46 is threadedly secured to a boss 48 that projects upwardly from the upper surface 10U of the main body portion of the rotor 10.

In accordance with the present invention the rotor 10 is provided with at least one, but preferably a symmetrically disposed pair, of projections 52A and 52B. The projections 52A and 52B are formed into a mounting member, or collar, 54 and each is attached to the collar 54 through a frangible connecting region 56A and 56B, respectively. Each projection is sized and positioned on the rotor 10 so that the amount of unbalance imparted by each projection to the rotor is less than a predetermined value of unbalance.

Unbalance is the condition which exists in a rotor when vibratory force or motion is imparted to its bearings as a result of centrifugal force. The quantitative measure of unbalance in a rotor (referred to a plane), without referring to its angular position, is obtained by taking the product of the unbalance mass and the distance of its center of gravity from the rotational axis. Unbalance is measured in ounce- or gram-inches, both having a similar meaning, namely a mass multiplied by its distance from the rotational axis. The gram-inch is the unit of unbalance is used in this application. This system is consistent with the Schenck-Trebel system of measurement of unbalance as described in the "Theory of Balancing", prepared by Schenck Treble Corporation, Third Edition, February 1976.

In accordance with the present invention each projection is sized and positioned on the rotor so as to exhibit a predetermined value of unbalance that is less than the multiplication product of 0.5 gram-inches for each pound of rotor weight. By selecting the projection's size and position in accordance with the present invention the projection may thus separate from the rotor without unbalancing the same to an extent sufficient to cause the rotor to leave the drive member.

For example, in the embodiment shown in the Figures, for a twenty pound centrifuge rotor having a pair of projections 52A and 52B the unbalance imparted by each projection 52A or 52B is less than ten gram-inches. Thus a pair of projections each weighing ten grams may be each positioned one inch from the centerline VCL of the rotor. Similarly, if each projection weighs five grams, it is positioned two inches from the centerline VCL. If a single projection is used, the permissible unbalance due to that projection is similarly ten gram-inches. Thus, a single projection weighing ten grams may be positioned one inch from the centerline VCL of the rotor. Of course, if a single projection is used, some appropriate counterbalancing mass should be positioned on the rotor. It should be understood that more than two projections 52 may be used, again so long as the unbalance imparted by each projection is less than the predetermined value for the rotor, derived as discussed.

Figure 2:
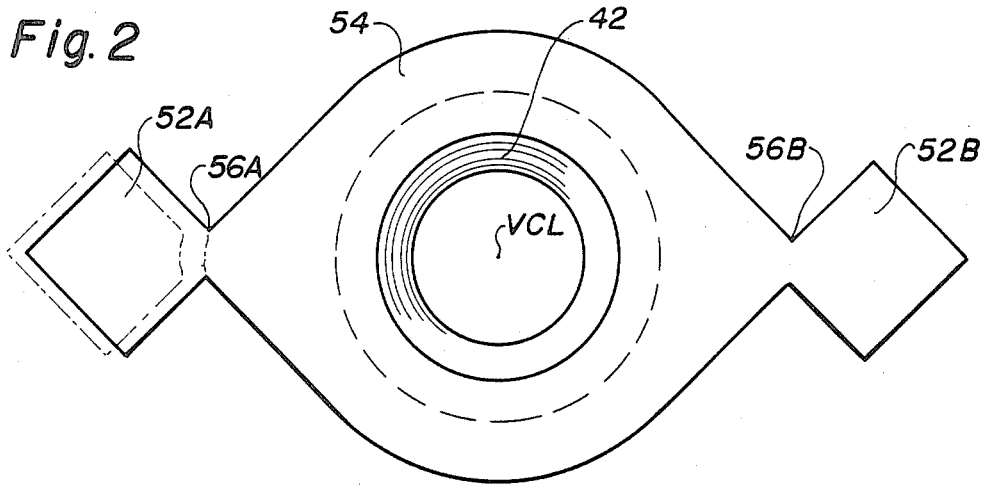
FIG. 2 is a view taken along view lines 2—2 of FIG. 1 showing a bottom view of the rotor of FIG. 1; and, FIG. 3 is an exploded perspective view of a rotor in accordance with the present invention having a removable collar with a pair of projections mounted thereto.

In accordance with the preferred embodiment of the invention shown in FIGS. 1 and 2 the collar 54 to which the projections 52A and 52B are mounted is integrally formed on the rotor 10 at any suitable location thereon. As seen in FIGS. 1 and 2 the collar 54 is formed in the body of the rotor 10 at a point adjacent to the lower surface 10L thereof. The collar 54 is machined into the the body of the rotor 10 to surround the recess 42. Of course, the collar 54 may be formed on the body of the rotor 10 adjacent the upper surface 10U thereof, as indicated by the dot-dash lines in FIG. 1. It should be understood that the projections 52 may be mounted in any other convenient manner and on any other convenient location on the body of the rotor 10 and remain within the contemplation of the present invention.

Figure 3:
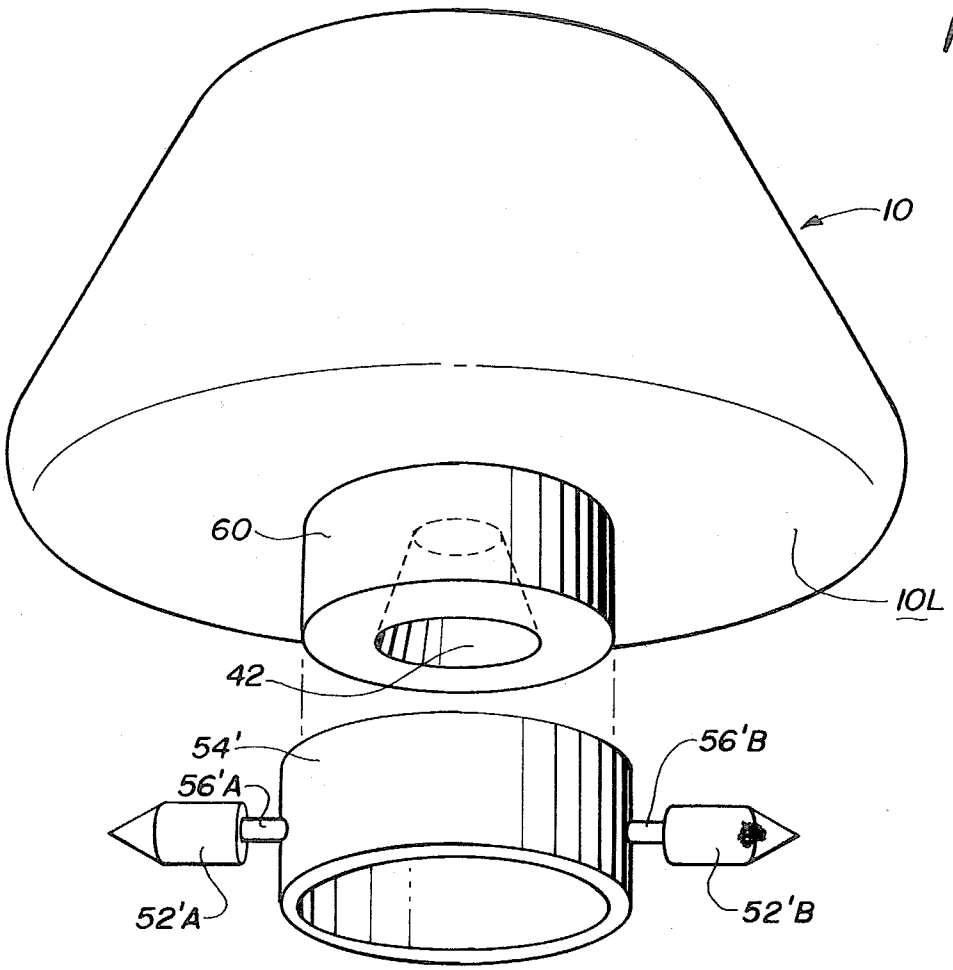

The mounting member may be other than integrally formed in the body of the rotor 10. Thus, as seen in FIG. 3 the projections 52'A and 52'B (assuming two projections are used) are connected via the frangible connections 56'A and 56'B, respectively, to a collar 54'. The collar 54' may be mounted to the rotor by any suitable means of attachment. The collar 54' in this embodiment is an annular member that is sized to be received onto a suitable boss 60 formed on the rotor 10 at any convenient location thereon. In the embodiment of the invention shown in FIG. 3 the collar 54' is press fit onto the boss 60 that is provided on the undersurface 10L of the rotor 10. The recess 42 is provided in the boss 60. The boss 60 may be provided adjacent to the upper surface of the rotor, if desired.

The projections 52 may be configured in any convenient manner. In FIG. 2 the projections 52 are shown as substantially diamond-shaped, while in FIG. 3 the projections 52' are bullet-like in configuration. However configured, the projections 52 or 52' are each attached to the rotor 10 through a frangible connection 54 or 54'. Of course it should be understood that the projections may be mounted to the rotor by any suitable means of attachment so long as the connection responds to the speed of the rotor 10 in the manner to be described.

In operation, the rotor 10, having the projections 52A and 52B or 52'A and 52'B suitably affixed thereto, is introduced into the chamber 16 onto the drive spud 40. The chamber 16 is evacuated and motive energy is applied to the rotor 10 causing the same to rotate about the axis of rotation VCL. If the rotor speed exceeds a predetermined threshold speed centrifugal stresses acting on the projections causes one of them to fracture in the region of their frangible connections.

As a result the separated projection, such as the projection 52A shown in FIG. 2, is liberated within the chamber 16 and form a projectile therein. The frangible connections 56, 56' are designed to fracture at a speed well below the disintegration speed of the rotor 10 yet at a speed that imparts sufficient energy to the projectile to cause it to puncture the chamber 16. This action opens the chamber 16 to the ambient air. When drawn into the chamber, the ambient air serves to windage limit the speed of the rotor 10.

Since the projections 52 or 52' are sized and positioned on the rotor 10 with the maximum unbalance values discussed above the separation of the projection 52 or 52' from the rotor 10 occurs without causing the rotor 10 to leave the drive spud 40. As a result the rotor 10 is not displaced in the chamber 16 and the tendency of the rotor cover 46 to separate from the body of the rotor 10 is minimized. Moreover the possibility of damage to the rotor is virtually eliminated. It is noted that in the event that both of the projections 52A and 52B, or 52'A and 52'B separate from the rotor 10 substantially simultaneously no unbalance is imparted to the rotor. However, in this instance, two projectiles are nevertheless formed. The projectiles would puncture the chamber, opening it to ambient air to windage limit the rotor speed.

Those skilled in the art, having benefit of the teachings of the present invention may effect numerous modifications thereto. These modifications are to be construed as lying within the contemplation of the present invention, as defined by the appended claims.

What is claimed is:

1. A centrifuge rotor for use in a centrifuge instrument of the type having an enclosable and evacuable chamber with a drive member adapted to connect the rotor to a source of motive energy projecting into the chamber, the rotor having a predetermined weight associated therewith, the rotor having at least a first projection connected thereto through a frangible connecting region, the frangible connecting region being configured so as to fracture and thereby separate the projection from the rotor when the rotor is driven to a predetermined rotational speed, the projection being sized and positioned on the rotor so as to exhibit an unbalance of less than the multiplication product of 0.5 gram-inches for each pound of rotor weight so that the projection may separate from the rotor without unbalancing the same to an extent sufficient to cause the rotor to leave the drive member, the projection upon separation from the rotor forming a projectile having an energy content sufficient to puncture the chamber to admit ambient air thereinto thereby to windage limit the rotational speed of the rotor.

2. The centrifuge rotor of claim 1 wherein the rotor has an upper and a lower surface thereon and wherein the projection is mounted to the rotor adjacent to the lower surface thereof.

3. The centrifuge rotor of claim 2 wherein the projection is integrally formed with the rotor.

4. The centrifuge rotor of claim 1 wherein the rotor has an upper and a lower surface thereon and wherein the projection is mounted to the rotor adjacent to the upper surface thereof.

5. The centrifuge rotor of claim 4 wherein the projection is integrally formed with the rotor.

6. The centrifuge rotor of claim 1 wherein the projection is integrally formed with the rotor.

7. The centrifuge rotor of claim 1 wherein the rotor has a boss on the lower surface thereof, further comprising: and a collar having the projection connected thereto through the frangible connection, the collar being attached to the boss on the rotor.

8. The centrifuge rotor of claim 1 wherein the rotor has a boss on the upper surface thereof, further comprising: and a collar having the projection connected thereto through the frangible connection, the collar being attached to the boss on the rotor.

9. A centrifuge rotor for use in a centrifuge instrument of the type having an enclosable and evacuable chamber with a drive member adapted to connect the rotor to a source of motive energy projecting into the chamber, the rotor having a predetermined weight associated therewith, the rotor having a first and a second projection each connected to the rotor through a frangible connecting region, each frangible connecting region being configured so as to fracture and thereby separate the projection associated therewith from the rotor when the rotor is driven to a predetermined rotational speed.

each projection being sized and positioned on the rotor so as to exhibit an unbalance of less than the multiplication product of 0.5 gram-inches for each pound of rotor weight so that the projection may separate from the rotor without unbalancing the same to an extent sufficient to cause the rotor to leave the drive member, each projection being sized and configured to form a projectile having an energy content sufficient to puncture the chamber to admit ambient air thereinto and thereby to windage limit the rotational speed of the rotor.

10. The centrifuge rotor of claim 9 wherein the rotor has an upper and a lower surface thereon and wherein the projections are mounted to the rotor adjacent to the lower surface thereof.

11. The centrifuge rotor of claim 10 wherein the the projections are integrally mounted to the rotor.

12. The centrifuge rotor of claim 10 wherein the rotor has a boss on the upper surface thereof, further comprising:

a collar having the projection connected thereto through the frangible connection, the collar being attached to the boss on the rotor.

13. The centrifuge rotor of claim 9 wherein the rotor has an upper and a lower surface thereon and wherein the projections are mounted to the rotor adjacent to the upper surface thereof.

14. The centrifuge rotor of claim 13 wherein the the projections are integrally mounted to the rotor.

15. The centrifuge rotor of claim 9 wherein the the projections are integrally mounted to the rotor.

16. The centrifuge rotor of claim 9 wherein the rotor has a boss on the lower surface thereof, further comprising:

a collar having the projections connected thereto through the frangible connections, the collar being attached to the boss on the rotor.

17. The centrifuge rotor of claim 16 wherein the collar is press fit onto the boss.

18. The centrifuge rotor of claim 17 wherein the projections are each substantially diamond-shaped.

19. The centrifuge rotor of claim 16 wherein the collar is integrally formed with the boss.

20. The centrifuge rotor of claim 17 wherein the projections are each substantially diamond-shaped.

* * * * *